United States Patent [19]

Erwin et al.

[11] Patent Number: 4,559,444

[45] Date of Patent: Dec. 17, 1985

[54] POSTAGE METER

[75] Inventors: Timothy R. Erwin, West Redding; Robert E. Manna, Newtown, both of Conn.

[73] Assignee: Pitney Bowes Inc., Stamford, Conn.

[21] Appl. No.: 701,717

[22] Filed: Feb. 14, 1985

[51] Int. Cl.[4] ..... G07G 1/00

[52] U.S. Cl. ..... 235/101; 101/106; 101/110

[58] Field of Search ..... 235/101; 101/59, 68–70, 101/79–83, 85, 91, 99, 106, 110, 269, 314, 320, 324

[56] References Cited

U.S. PATENT DOCUMENTS

| | | | |
|---|---|---|---|
| 2,795,186 | 6/1957 | Bach et al. | 101/269 |
| 2,829,591 | 4/1958 | Rouan | 101/91 |
| 3,682,378 | 8/1972 | Rouan et al. | 235/101 |
| 4,007,359 | 2/1977 | Ford | 235/101 |
| 4,287,825 | 9/1981 | Eckert, Jr. et al. | 101/91 |

*Primary Examiner*—Benjamin R. Fuller

*Attorney, Agent, or Firm*—David E. Pitchenik; William D. Soltow, Jr.; Albert W. Scribner

[57] ABSTRACT

A postage meter having a fixed coplanar printing die is provided with security means to prevent making of fraudulent impressions. This security means involves the use of interposers extending upward and through the space into which an envelope or other workpieces may be inserted. During the legitimate cycling operation these interposers are moved out of guarding position and the postage meter carries out its normal function.

11 Claims, 3 Drawing Figures

Fig. I.
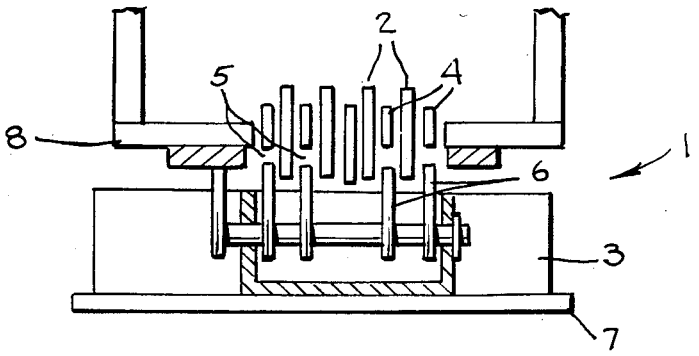
Fig. II.
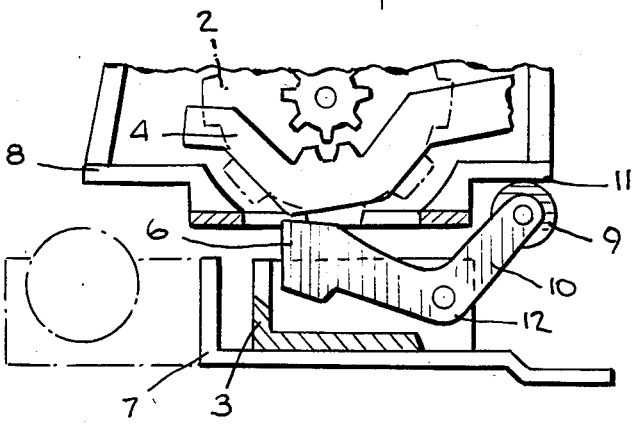
Fig. III.
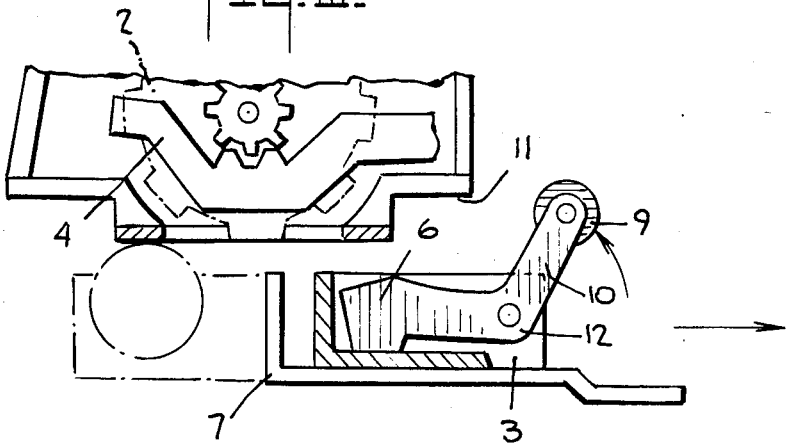

POSTAGE METER

This invention relates to postage meters and, more particularly, to a die protector useful in meters comprising a fixed coplanar printing die.

BACKGROUND OF THE INVENTION

In postage meters and other value printing devices a risk exists that an unauthorized user may insert an envelope or other workpieces into the housing within the meter to affect an impression of value known as "wiping-off". In all types of postage meters a security system to prevent unauthorized impressions from being made is important. This safeguard is needed to maintain the integrity of the meter and to provide a proper accounting of printed postage. This security system, however, in addition to being reliable, must be relatively usable and compatible with existing postage meter designs. The need for a reliable tamper-proof system exists in both postage meters having rotatable valve dispensing means and those using a die having substantially coplanar type.

It is known to provide various tamper-proof features in postage meters having a rotatable printing drum. In U.S. Pat. Nos. 2,828,591; 3,682,378; and 4,007,359 typical postage meters having mechanisms which rotate to print a postage impression of a selected value are described. In these prior art devices the drive gears and racks compel the presence of narrow spaces between the type wheels. It is in these spaces that the die protection means are provided. These protection means will project out from the face of the die at times during the printing cycle when it is desired that no impression be taken. Thus, envelopes or other workpieces cannot be fit into these spaces to obtain a bogus impression. In U.S. Pat. No. 2,829,591 the die protection means involves the use of thin leaf-like levers or blades which are sandwiched between the type wheels and have activating arms projecting to one side of the printing surface of the type wheels. These arms are retractable below this surface to permit printing at appropriate times. In U.S. Pat. No. 4,007,359 a rotatable drum postage meter is described which comprises a directly accessible hand manipulatively settable postage value selector means, a variable postage printing means and a postage registering means. The printing means and the registering means are only operable upon rotation of the drum from a rest position through a metering cycle. While these patents disclose effective die protection means, they all are limited to rotatable drum type postage meters.

Security features in a rotary meter are different from those in a platen meter. In a rotary meter the full die face is never exposed as in platen printing. There are no retractable mechanisms in a rotary meter (such as those disclosed in U.S. Pat. No. 4,007,359) which prevent access to the full die face.

In U.S. Pat. No. 2,795,186 a value printing device comprising a fixed substantially coplanar printing die is described. In this device there is provided a movable shroud which can be lowered to guard the printing die against taking unauthorized impressions at any time between legitimate printing operations. There are also described means for locking the shroud in guarding position except when the mechanism is operated in a normal manner to simultaneously print and register. This shroud in effect completely covers the face of the value printing die when the mechanism is not in an operating cycle. This security structure comprises a shroud overlying the guide table which serves in part as an inverted upper guide table. In home position the shroud depends a substantial distance below the surface of the printing die and forms with the table a guide chute into which a workpiece may be conducted without danger of smudging the same on the surface of the printing die and without conflicting with the edge of the platen. The shroud is supported for vertical reciprocating movement by means of four parallel links each pivoted at one end on a stud extending from the frame. Means is also provided for determining the lower limit of movement of the shroud and for preventing lifting of the shroud until the printing stroke has been commenced. This means includes a pair of slides, one on each side of the frame. The slide is mounted for sliding movement on two studs. The slide is slidable on these studs. Each of the slides has an irregularly shaped cam slot including a narrow throat portion which cooperates with a projection on the adjacent portion of the shroud. The throat portions of the slots are so configured as to prevent raising of the projections and hence of the shroud when the parts are in home position, whereby the shroud also performs the function of assisting in preventing the taking of unauthorized impressions from the value printing die. This prior art device involves completely covering the face of the printing die. This type of security system for value printing devices comprising fixed coplanar printing dies still allows one to insert an envelope or meter tape into the printing area and possibly wiping-off impressions. The only way to truly prevent wiping-off is to mechanically prevent access to the dies while the machine is at rest.

SUMMARY OF THE INVENTION

It is therefore an object of this invention to provide a protector for printing means in value printing devices which is devoid of the above-noted disadvantages.

Another object of this invention is to provide a postage meter die protector with flat bed type printers.

A further object of this invention is to provide a postage meter comprising means for preventing unauthorized value impressions.

Another further object of this invention is to provide a postage meter die protector that is relatively simple to manufacture and conveniently incorporated or retrofitted into existing models.

Still a further object of this invention is to provide effective means in a flat bed printing postage meter to prevent the making of fraudulent impressions.

These and other objects of this invention are accomplished generally speaking by providing a novel component for a flat bed printing postage meter comprising blades or arms that are movably positioned adjacent the print wheels and extend upwardly to a plane beyond the lowest plane from which the print wheel extends. These arms or blades extend up into the gap or space that is defined between the print wheels' lowest component and the surface of the workpiece guide table. Thus, an envelope or other workpiece cannot be inserted into this gap to obtain a fraudulent impression. During the operation of the meter in a printing cycle, these blades or arms are moved out of guarding position so that a legitimate impression can be made. In the home or guarding position the rectifiers have rotated down allowing the print wheels to select postage. The inker bracket is forward in the machine positioning the letter guide block beneath the indicia face. The roller on the die protector has interlocked with the bottom edge of the indicia flange and driven the protector blades or arms up into the indicia window. These blades prevent access by paper, tape or other workpieces for making fraudulent impressions. When the meter cycles or prints the postmark and postal value, the inker bracket moves back into the machine to ink the indicia. As it moves backwards, the roller becomes disengaged from the indicia flange allowing the protector blades to revolve down and expose the indicia which is then ready to print. The protector means may be of any suitable structure that permits them to extend upwardly beyond the plane of the lowest component of the print wheel. They may be made from any suitable material such as metal or polymeric materials such as plastic, fiber glass, or other synthetic materials. Because of necessary tolerances in manufactured parts, there generally is a gap or space in finished flat bed print postage meters where unauthorized impressions can be made on workpieces. The present invention provides means to eliminate this potential problem. It is preferred that these protector means be in the form of blades or arms to be described more fully in the ensuing discussion with reference to the drawings.

BRIEF DESCRIPTION OF DRAWING

FIG. 1 is a front sectional view of a flat bed printing postage meter with parts broken away to illustrate the protective arms of this invention when in a home position.

FIG. 2 is a side sectional view of a flat bed printing postage meter with parts broken away to illustrate the protective arms of this invention when in a home position.

FIG. 3 is a side sectional view of a flat bed printing postage meter with parts broken away to illustrate the protective arms of this invention when in a cycling position.

DESCRIPTION OF DRAWING AND PREFERRED EMBODIMENTS

In FIG. 1 a front sectional view of meter 1 is shown when at rest in a home or non-operating mode. Parts including the meter housing are broken away so that the details of the invention can be clearly shown. Print wheel 2 of a conventional flat bed printing postage meter is positioned above letter guide block 3. The bottom surface of the letter guide block 3 directs a workpiece into printing position when it is inserted into the meter for value marking. Adjacent the separate unit print wheels 2 are located rectifiers 4 which are shown in their down position allowing the print wheels 2 to revolve or select postage value. When the meter cycles as shown in FIG. 3 to print the postmark and value, the rectifiers 4 revolve up detenting the gear portions on the print wheels aligning the printing characters to print in a row. The rectifiers 4 do not extend downwardly as far as do the print wheels 2, thus allowing a gap or space 5 to be formed therebetween. It is in these gaps 5 that the protector blades 6 extend upwardly into. The protector blades 6 may be located in at least one of these gaps 5 at any horizontal location. It is preferred that two blades 6 be used, one on each side of the print wheel 2. That is, a protector blade 6 is located below each terminal rectifier located on each horizontal end of the print wheel 2 mechanism. In the home position as shown in FIG. 1, the rectifiers 4 have rotated down allowing the print wheels 2 to select postage. The inker bracket 7 is forward in the machine, positioning the letter guide block 3 beneath the indicia face 8. The roller 9 attached on the rear end of protector arm 10 as shown in FIG. 2 has interlocked with the bottom edge of the indicia flange 11 and driven the protector blades 6 up into the indicia window and in gaps 5 located between the print wheel segments 2. These blades 6 prevent access by paper or other workpieces for making unauthorized impressions when the device is in the home position of FIGS. 1 and 2.

In the cycling position illustrated in FIG. 3, the meter 1 cycles and prints the postmark and postal value selected by the operator. The inker bracket 7 moves back into the machine to ink the indicia 8. As the inker bracket 7 moves backward, the roller 9 becomes disengaged from the indicia flange 11 which allows the protector blades 6 to revolve down and expose the indicia 8 and print wheel 2. The blades 6 are on one terminal end portion of blade arm 10 and roller 9 is located on the opposite end of arm 10. Arm 10 is rotatably connected at its elbow portion 12 to letter guide block 3 which permits it to be raised as in FIG. 2 or be lowered as in FIG. 3 depending upon the movement and location of roller 9. When the inker bracket moves backward in a horizontal direction, roller 9 is free from any constraint and blades 6 rotate down away from gaps 5. When inker bracket 7 and roller 9 are moved forward roller 9 contacts and moves under indicia flange 11, arm 10 rotates and drives blades 6 into gaps 5 and the device is in guarding or home position. These blades 6 would interfere with any attempt to force an envelope or other workpiece between the space between letter guide block 3 and print wheel 2. The mechanism illustrated is constructed of a single sheet metal (preferably stainless) piece which has been cut and bent to form the two or more protector blades 6 and the blade arm 10. The plastic roller 9 rotates on a stud which is attached to the blade arm 6. The mechanism rotates around its elbow portion 12 upon a shaft which is fixed to the letter guide block 3. In the forward inker (home) position, the roller 9 is engaged under the indicia plate 8 rotating the mechanism clockwise and driving the blades 6 into the gaps 5 thus preventing access to the print dies. When the inker moves into the machine during cycling, the roller 9 is disengaged from the indicia plate 8 allowing the mechanism to rotate counterclockwise removing the blades 6 from the gaps 5. A spring drives the blades down assuring the inker free movement into the machine during cycling. At the end of cycling when the inker returns to its "home" position, the roller 9 again engages the indicia plate 8 rotating the mechanism, driving the blades 6 into the gaps 5.

The preferred and optimumly preferred embodiments of the present invention have been described herein and shown in the accompanying drawing to illustrate the underlying principles of the invention, but it is to be understood that numerous modifications and ramifications may be made without departing from the spirit and scope of this invention.

What is claimed is:

1. A postage meter having in a non-cycling position a flat bed printing mechanism comprising a print wheel having a plurality of wheel segments, an inker assembly, a letter guide means, and at least one protector arm, said print wheel segments having interposed therebetween rectifiers having smaller vertical dimensions than said print wheel segments, forming thereby a gap between said segments, said letter guide block in adjacent and vertical spaced relationship to said print wheel and separated therefrom by a space, said protector arm extending upwardly into said gap and through said space to form thereby a blocking means to any workpiece contact with said print wheel.

2. The postage meter of claim 1 wherein said arm comprises at its forward portion a protector blade.

3. The postage meter of claim 1 wherein said arm comprises at its rear portion a roller means adapted to control the vertical movement of said arm.

4. The postage meter of claim 1 wherein said arm comprises a blade at its forward portion and roller means at its rear portion, said arm movably attached to said letter guide means at a point between said blade and said roller, said arm adapted to move into and out of said gaps.

5. The postage meter of claim 1 wherein said arm is adapted to be disengaged and lowered out of contact with said gap to permit thereby access to said print wheel by a workpiece to be marked.

6. The postage meter of claim 1 wherein said arm and said letter guide means are attached and both adapted to move in a horizontal manner when said protector arm is engaged and disengaged.

7. A flat bed printing postage meter in a non-cycling position, comprising in combination a letter guide means, a print wheel assembly, an inker assembly and at least one protector arm, said print wheel assembly comprising a plurality of side by side segments each separated by a rectifier, said rectifier having smaller vertical dimensions than said segments to form thereby a gap between each adjacent segment, said protector arm having at its forward portion a protector blade, said letter guide means being separated from said print wheel assembly by a space, said protector blade extending upward through substantially the entire said space and into said gap to provide thereby a blocking means to workpiece contact with said print wheel.

8. The postage meter of claim 7 wherein said arm comprises at its rear portion a roller means adapted to control the vertical movement of said arm.

9. The postage meter of claim 7 wherein said arm comprises a blade at its forward portion and a roller means at its rear portion, said arm movably attached to said letter guide means at a point between said blade and said roller, said arm adapted to move into and out of said gaps.

10. The postage meter of claim 7 wherein said arm is adapted to be disengaged and lowered out of contact with said gap to permit thereby access to said print wheel by a workpiece to be marked.

11. The postage meter of claim 7 wherein said arm and said letter guide means are attached and both adapted to move in a horizontal manner when said protector arm is engaged and disengaged.

* * * * *